United States Patent [19]

Idstein

[11] 4,315,622

[45] Feb. 16, 1982

[54] DETACHING DEVICE FOR SHEET MATERIAL

[75] Inventor: Hermann Idstein, Oestrich-Winkel, Fed. Rep. of Germany

[73] Assignee: Hoechst Aktiengesellschaft, Frankfurt am Main, Fed. Rep. of Germany

[21] Appl. No.: 159,515

[22] Filed: Jun. 16, 1980

[30] Foreign Application Priority Data

Jun. 28, 1979 [DE] Fed. Rep. of Germany ..... 2926085

[51] Int. Cl.[3] ..... B65H 29/54

[52] U.S. Cl. ..... 271/311

[58] Field of Search ..... 271/311, 307, 308, DIG. 2; 118/60, 245; 432/60

[56] References Cited

U.S. PATENT DOCUMENTS

| | | | |
|---|---|---|---|
| 3,881,859 | 5/1975 | Hamilton | 271/DIG. 2 X |
| 3,938,950 | 2/1976 | Weiler | 271/DIG. 2 X |
| 3,957,423 | 5/1976 | Mueller . | |
| 3,981,085 | 9/1976 | Franko | 271/DIG. 2 X |
| 4,000,963 | 1/1977 | Thettu . | |
| 4,060,320 | 11/1977 | Doi | 271/308 X |
| 4,065,120 | 12/1977 | Imaizumi | 271/DIG. 2 X |

FOREIGN PATENT DOCUMENTS 2259213 4/1979 Fed. Rep. of Germany .

*Primary Examiner*—Richard A. Schacher

*Attorney, Agent, or Firm*—Schwartz, Jeffery, Schwaab, Mack, Blumenthal & Koch

[57] ABSTRACT

The invention relates to a device for detaching sheet material from a roller 1. The detaching device comprises a number of pivotable detaching fingers 2, each of which has a contact surface 10 of concave shape, the curvature of which matches the convex surface curvature of the roller 1. Each detaching finger 2 is pivotably mounted by means of a carrying pin 7 in a holding bow 3 mounted on a carrier rod which is mounted in two side members 19. The contact surface 10 has a convex curve extending transversely to the concave shape.

6 Claims, 5 Drawing Figures

1
11
18
4
6
5
19
3
2
7
19

20
10
9
8

DETACHING DEVICE FOR SHEET MATERIAL

BACKGROUND OF THE INVENTION

1. Field of the Invention

The invention relates to a device for detaching sheet material from the surfaces of rollers, which comprises a number of pivotable detaching fingers having front faces which bear against the surface of the rollers.

2. The Prior Art

In electrostatic copying processes, a latent electrostatic image of the original which is to be copied is formed on the image recording material. The electrostatic charge pattern is developed and made visible by the application of toner. In most cases the developed charge pattern is transferred to an image carrier, for example, a sheet of paper, and fixed thereon by the application of heat. In copying machines, driven pairs of rollers attend to the delivery of the image carrier, the application of toner, and the heating of the developed charge image on the image carrier. It is then generally necessary for the image carrier, which, for example, passes out through a gap between two rollers facing one another, to be reliably detached from the roller surface with the aid of a stripping device provided with stripping bars or stripping fingers, in order to ensure rectilinear further delivery of the image carrier or to divert the image carrier from the gap on a prescribed path to a conveyor device, such as a conveyor belt or the like, which delivers the image carrier to the outlet point of the copying machine. A stripping device of this kind is generally in contact with the roller or cylinder surface which—particularly in the case of the image recording drum, which for example is provided with an organic photoconductor or coated with selenium or other photosensitive material—is very susceptible to mechanical influences and can very easily be damaged and functionally impaired thereby.

In German Offenlegungsschrift No. 24 44 876, a stripping device is described as having pivotably-mounted stripping fingers which bear with their leading edges against the peripheral surface of a heated roller. The stripping fingers are pivotable about the free ends of pivot pins anchored at one end in vertical supports which in turn are carried by long rods fastened to a supporting frame of the copying machine. Each stripping finger is provided with a narrow contact edge formed by the line of intersection of a horizontal upper face and of a lower face extending obliquely thereto. This contact edge in the form of a wedge-shaped knife edge is rectilinear and lies against the peripheral surface of the roller. It is obvious that, on the rotation of the roller, this contact edge continuously abrades the surface of the roller within the area of contact and leads to rapid wear of that surface. With this known device, it cannot be ensured that the contact surface of the stripping fingers will lie exactly parallel against the surface of the roller, if there are even slight tolerance deviations of the individual dimensions of the stripping fingers. Instead of the desired linear contact along the contact surface of the stripping fingers, practically only point contact will be achieved, and this will considerably accelerate the wear on the roller surface.

Premature wear of the roller surface must also be avoided for fixing rollers, which generally have a coating of polytetrafluoroethylene of a thickness of up to about 50 μm on the surface.

SUMMARY OF THE INVENTION

It is an object of the invention to provide a detaching device for image carriers in sheet form which enables the image carriers to be detached or stripped from the roller surface with minimum damage to the roller, in order thereby to lengthen the life of the latter.

This object is attained in accordance with the invention, wherein each detaching finger has a contact surface of concave shape whose curvature matches the convex surface curvature of the roller. Furthermore, the contact surface of the individual detaching finger has a convex curve extending transversely to the concave shape.

With this concave shape, which is specially adapted to the given diameter of the roller, and with the transverse convex curve of the contact surface, the advantage is gained that the contact surfaces of the individual stripping fingers ensure absolutely non-injurious linear contact with the roller surface, even when the stripping fingers are in an inclined position.

Further objects, advantages and features of the invention will become apparent from the detailed description which follows with reference to the preferred embodiment illustrated in the accompanying drawings.

THE PREFERRED EMBODIMENT

Figure 1:
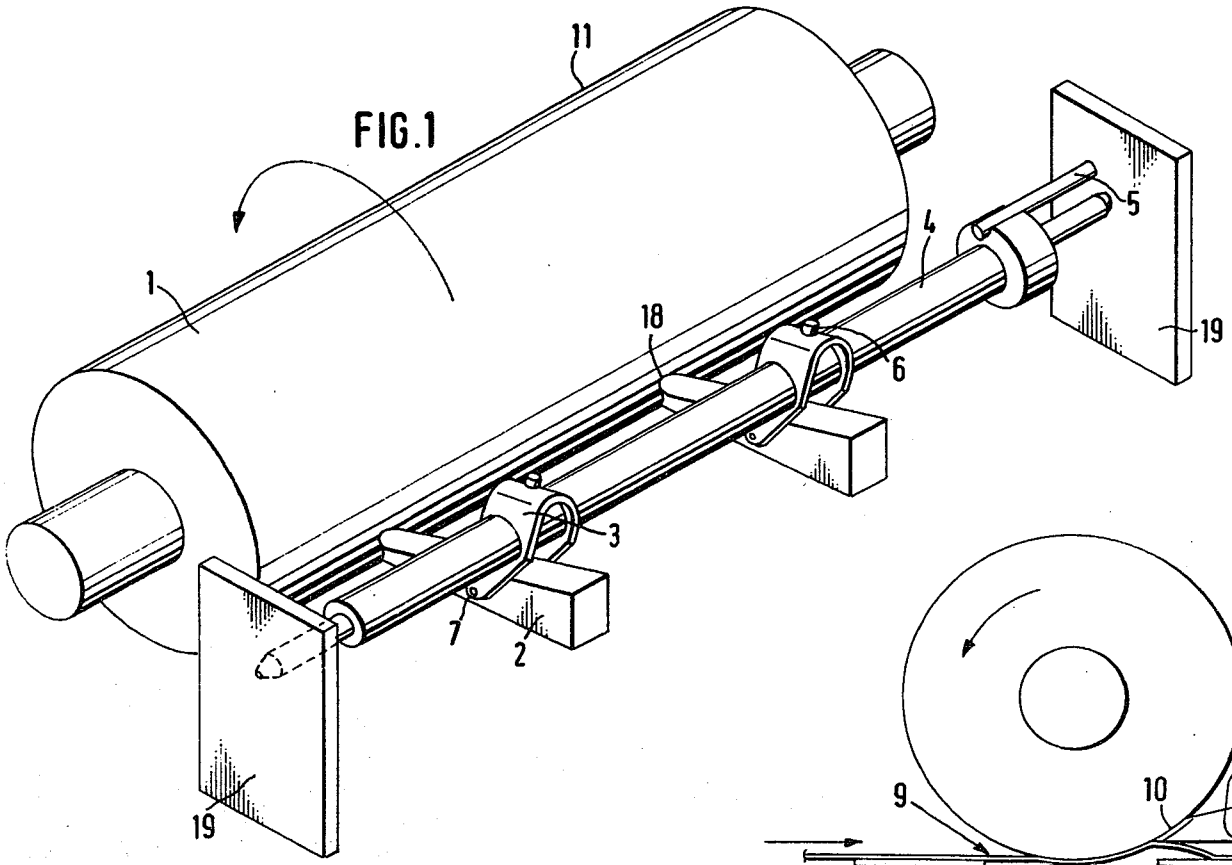
FIG. 1 shows in perspective view a roller with a detaching device according to the invention, lying against it.
Figure 2:
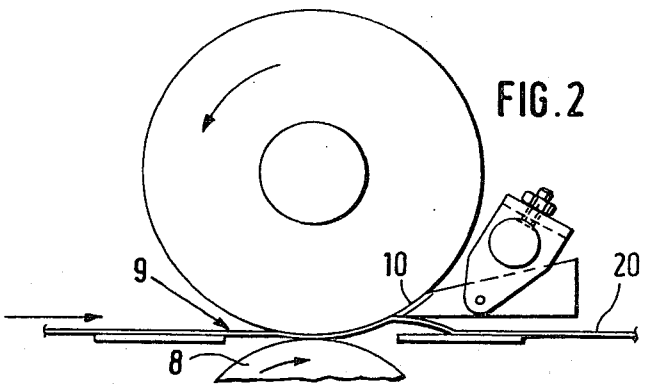
FIG. 2 shows a side view of the arrangement of FIG. 1.

The detaching device shown in perspective in FIG. 1 comprises a carrier rod 4 on which are mounted holding bows 3 in which detaching fingers 2 are pivotably mounted. In FIG. 1, only two detaching fingers 2 are shown, but more than two detaching fingers may be provided. Their number depends on the length of a roller 1 from whose surface 11 an image carrier 20 in sheet form is to be detached, as can be seen in FIG. 2.

Figure 3:
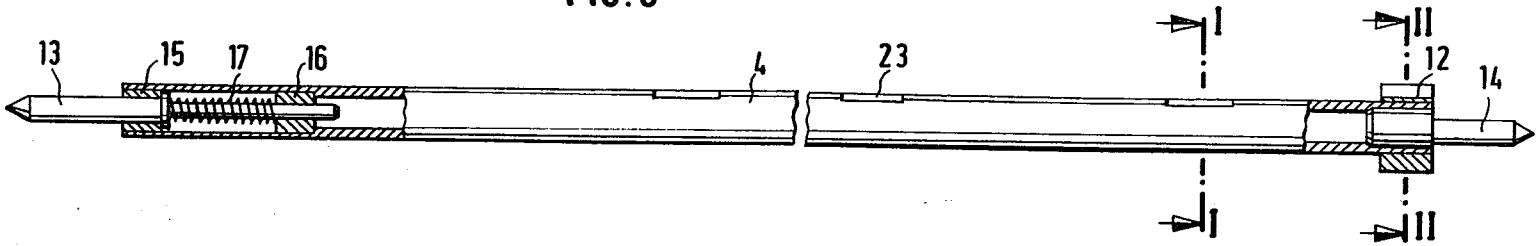
FIG. 3 shows, partly in section, a part of the detaching device.

Each holding bow 3 is formed into a U-shaped shackle, and the two parts of the shackle are provided with holes of diameters such that the carrier rod 4 can pass through the holding bows 3. In the bottom part of the bevelled portions of each shackle is provided a carrying pin 7, which passes through the respective detaching finger 2 and forms its pivot pin. In the curved portion of the holding bow 3 is provided an adjusting screw 6, the bottom end of which engages in a slot-like recess 23 (FIG. 3) in the carrier rod 4, in a manner not illustrated.

The individual holding bow 3 is slideable along the carrier rod 4 and, with the aid of the adjusting screw 6, can be secured in the selected position. Since the recesses 23 in the carrier rod 4 have only a determined length, it is obvious that each holding bow 3 is preferably adjusted only within this length. This does not, however, prevent the individual holding bow 3 from being secured outside the positions determined by the recesses 23, if this should be necessary, in which case the adjusting screw 6 lies under pressure directly against the surface of the carrier rod in order to position the holding bow 3 wherever desired.

The carrier rod 4 is mounted by its two ends in side members 19 of the machine. For this purpose, the carrier rod 4 is provided at one end with a fixed centering pin 14 and at the other end with a centering pin 13 which is resiliently mounted in a front guide bush 15 and a rear guide bush 16, and which is surrounded by a spring 17 bearing at one end against the inner surface of the rear guide bush 16 and at the other end against a stop on the centering pin 13. The spring 17 is in the form of a compression spring and urges the centering pin 13 outwardly. The two centering pins 13 and 14 engage in corresponding recesses (not shown) in the side members 19.

A positioning ring 12, which is provided with a recess 21, is mounted near the fixed centering pin 14 on the carrier rod 4. A positioning pin 5 extends parallel to the carrier rod 4. With the aid of the positioning pin 5, which is fastened in one side part 19, accurate angular and rotational orientation and also accurate spacing positioning of the carrier rod 4 between or in relation to the side parts 19 are ensured because the positioning pin 5 must engage in the recess 21 in the positioning ring 12, in order to enable the centering pin 14 to be positioned against the inner surfaces of the side members 19 through the displacement of the spring 17 and resilient centering pin 13.

Figure 3B:
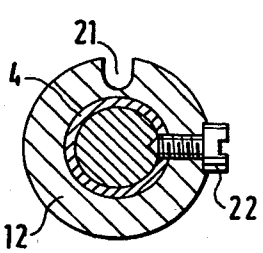
FIGS. 3*a* and 3*b* are sectional views taken along lines I—I and II—II, respectively, of FIG. 3.
Figure 3A:
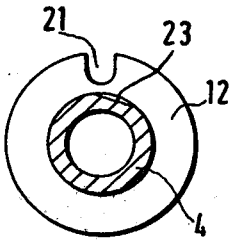

The fastening of the positioning ring 12 on the carrier rod 4 can be seen in FIGS. 3*a* and 3*b* and needs no further explanation. From the sectional drawings of FIGS. 3*a* and 3*b*, it can be seen that the conical point of the fastening screw 22, at the end of its screwthread, engages through the positioning ring 12 and into a conical slot or hole in the carrier rod 4. In FIG. 3*a* the recess 23 is shown in section.

The individual detaching finger 2 has a contact surface 10 which has a concave shape with a curvature adapted to the convex surface curvature of the roller 1. For this purpose the detaching fingers 2 are brought exactly to the size of the roller diameter by suitable machining, such as grinding or precision milling. At the same time a convex curve 18 extending transversely to the concave shape is also ground or precision milled by means of a forming milling cutter on the contact surface 10 of the detaching finger 2, the grinding wheel or forming milling cutter having a radiused concave shape on its peripheral surface. The connecting line between the two outermost points of the concavely curved grinding wheel or forming milling cutter expediently passes through the center point of the opening of the detaching finger 2 through which the carrying pin 7 passes when the detaching finger 2 is mounted in the holding bow 3.

Through this special machining adapted to the given roller diameter and to the suspension point of the detaching finger 2 in the holding bow 3 a contact surface 10 is obtained which insures linear contact between the detaching finger 2 and the roller surface 11 without damage to the roller. Exact radial linear guidance of the contact surface 10 on the periphery of the roller is thereby obtained, so that the image carrier 20 can be detached with considerable reduction of roller surface wear.

FIG. 2 illustrates diagrammatically the passage of the image carrier 20 through a gap between a roller 8 and the roller 1. The contact surface 10 lies with its concave shape against the roller surface 11, without an interspace. The curvature 18 of the contact surface 10 can be seen in FIG. 1.

The main difference between the invention and conventional stripping devices lies in that, with known stripping fingers which have a rectilinear stripping edge lying against the surface of the roller, the desired linear contact between the stripping edge and the surface of the roller in the axial direction is no longer ensured when there are even slight tolerance deviations, whereas in the case of the present invention linear contact is always obtained because of the concave shape of the contact surface 10 and the convex curve extending transversely thereto.

What is claimed is:

1. A device for detaching sheet material from the surface of a roller, having a convex surface, comprising:

a plurality of detaching fingers pivotably mounted relative to the roller on a carrier rod, each said detaching finger having a contact surface bearing against the surface of the roller, the contact surface having a concave shape with a curvature which matches the convex surface curvature of the roller, and further wherein each contact surface has a convex curvature in a direction transverse to the concave shape.

2. A detaching device as claimed in claim 1, further comprising:

means for receiving and retaining the carrier rod in spaced relation to the roller and generally parallel thereto; and a plurality of holding bows mounted on the carrier rod, wherein each said detaching finger is pivotably mounted in a respective holding bow.

3. A detaching device as claimed in claim 2, wherein each holding bow is slidable along the carrier rod, further including an adjusting screw passing through an opening in the holding bow and adjustable to bear against the carrier rod for securing the holding bow in a selected position on the carrier rod.

4. A detaching device as claimed in claim 2, wherein the carrier rod has, at one end thereof, a fixed centering pin and, at the other end thereof, a pair of spaced guide bushes and a further centering pin slidably mounted in the guide bushes and resiliently biased outwardly of the carrier rod, whereby the centering pins engage corresponding recesses in the receiving and retaining means.

5. A detaching device as claimed in claim 4, further comprising a positioning ring mounted on the carrier rod near the fixed centering pin, and a positioning pin fastened in one side part of the receiving and retaining means and extending inwardly and parallel to the carrier rod for orienting and positioning the carrier rod relative to the receiving and retaining means by engagement of the positioning pin in a recess in the positioning ring.

6. A detaching device as claimed in claim 3, wherein the carrier rod is provided with recesses in which the adjusting screws of the holding bows engage.

* * * * *